US008947021B2

(12) United States Patent
Tsutsui

(10) Patent No.: US 8,947,021 B2
(45) Date of Patent: Feb. 3, 2015

(54) ACCELERATOR AND CYCLOTRON

(75) Inventor: Hiroshi Tsutsui, Nishitokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 766 days.

(21) Appl. No.: 13/113,456

(22) Filed: May 23, 2011

(65) Prior Publication Data

US 2011/0291484 A1 Dec. 1, 2011

(30) Foreign Application Priority Data

May 26, 2010 (JP) ..... 2010-120716

(51) Int. Cl.
*H05H 13/00* (2006.01)
*H05H 7/08* (2006.01)

(52) U.S. Cl.
CPC *H05H 13/00* (2013.01); *H05H 7/08* (2013.01)
USPC ..... 315/502; 315/500; 315/501; 315/505; 250/396 R; 250/492.1; 250/493.1

(58) Field of Classification Search
CPC ..... H05H 7/08; H05H 7/10; H05H 13/00; H05H 13/05; H05H 2007/045; H05H 2007/087; H02J 9/00; H02J 7/00
USPC ..... 315/500, 501, 502, 503, 504, 505; 250/396 R, 396 ML, 492.1, 492.3, 493.1
See application file for complete search history.

(56) References Cited

U.S. PATENT DOCUMENTS

| | | | | |
|---|---|---|---|---|
| 4,808,940 | A * | 2/1989 | Toyota | 315/500 |
| 4,849,705 | A * | 7/1989 | Takayama | 315/507 |
| 2012/0142538 | A1* | 6/2012 | Antaya et al. | 505/211 |

FOREIGN PATENT DOCUMENTS

| | | | |
|---|---|---|---|
| JP | S62-170199 | A | 7/1987 |
| JP | S64-059800 | A | 3/1989 |

(Continued)

OTHER PUBLICATIONS

B. N. Gikal, et al., "Compensation of the Beam Vertical Defocusing at the Exit of U400 Cyclotron Spiral Inflector", Proceeding of RuPAC 2008, Zvenigorod, Russia, Dubna, Retrieved from the Internet: URL:http://accelconf.web.cern.ch/AccelConf/r08/papers/TUAPH12.pdf [retrived on Jan. 6, 2014], Oct. 7, 2008, p. 127-p. 129, XP055094880.

(Continued)

*Primary Examiner* — Douglas W Owens
*Assistant Examiner* — Thai Pham
(74) *Attorney, Agent, or Firm* — Squire Patton Boggs (US) LLP

(57) ABSTRACT

An accelerator includes an inflector through which a beam entering from an ion source passes and which introduces the beam to an acceleration orbit. The inflector includes a beam convergence unit that converges the beam passing through the inflector. A cyclotron, which accelerates a beam in a convoluted acceleration orbit, includes magnetic poles, D-electrodes, and an inflector. The magnetic poles generate a magnetic field in a direction perpendicular to the acceleration orbit. The D-electrodes generate a potential difference, which accelerates the beam, in the acceleration orbit. A beam, which enters in an incident direction perpendicular to the acceleration orbit, passes through the inflector, and the inflector bends the beam so as to introduce the beam to the acceleration orbit. The inflector includes a beam convergence unit that converges the beam passing through the inflector.

5 Claims, 8 Drawing Sheets

(56) References Cited

FOREIGN PATENT DOCUMENTS

| | | | |
|---|---|---|---|
| JP | S64-081200 | A | 3/1989 |
| JP | H4-062800 | A | 2/1992 |
| JP | 5-224657 | | 9/1993 |
| JP | 2004-241347 | A | 8/2004 |
| JP | 2005-302734 | A | 10/2005 |

OTHER PUBLICATIONS

Toprek D, et al., "Some optical properties of the spiral inflector", Nuclear Instruments & Methods in Physics Research. Section A: Accelerators, Spectrometers, Detectors, and Associated Equipment, Elsevier BV * North-Holland, Netherlands, vol. 431, No. 1-2, Jul. 11, 1999, p. 38-p. 45, XP004172951.

Toprek, et al., "Fringe field effects in the spiral inflector", Nuclear Instruments & Methods in Physics Research, Section B: Beam Interactions With Materials and Atoms, Elsevier, Amsterdam, NL, vol. 267, No. 7, ISSN: 0168-583X, DOI: 10.1016/J.NIMB.2009.02.056 [retrieved on Feb. 24, 2009], Apr. 15, 2009, p. 1175-p. 1181, XP026049549.

Tu Ts, et al., "Status Report of the U400 Cyclotron at the FLNR JINR Introduction", Proceedings of APAC 2004, Gyeongju, Korea, Retrieved from the Internet: URL:http://accelconf.web.cern.ch/AccelConf/a04/Papers/MOP10001.PDF [retrieved on Jan. 8, 2014], Oct. 31, 2005, XP055095192.

European Search Report dated Jan. 16, 2014.

* cited by examiner (a)

(b)

(c)

ACCELERATOR AND CYCLOTRON

RELATED APPLICATION

Priority is claimed to Japanese Patent Application No. 2010-120716, filed May 26, 2010, the entire content of which is incorporated herein by reference.

BACKGROUND

1. Technical Field

The present invention relates to a cyclotron and an accelerator including an inflector that introduces a beam to an acceleration orbit.

2. Description of the Related Art

In the past, a cyclotron has been known as a technique in this field. The cyclotron accelerates a beam in a convoluted acceleration orbit by the actions of magnetic poles and D-electrodes in an acceleration space, and outputs the beam. The beam enters the cyclotron in the incident direction perpendicular to the acceleration orbit. Further, the cyclotron can make the beam go into the acceleration orbit in the acceleration space by bending the beam, which is emitted from a beam source, at an angle of 90° by an inflector.

SUMMARY

According to an embodiment of the invention, there is provided an accelerator including an inflector through which a beam entering from an ion source passes and which introduces the beam to an acceleration orbit. The inflector includes a beam convergence unit that converges the beam passing through the inflector.

Further, according to another embodiment of the invention, there is provided a cyclotron that accelerates a beam in a convoluted acceleration orbit. The cyclotron includes magnetic poles that generate a magnetic field in a direction perpendicular to the acceleration orbit; D-electrodes generating a potential difference, which accelerates the beam, in the acceleration orbit; and an inflector through which a beam entering in an incident direction perpendicular to the acceleration orbit passes and which bends the beam so as to introduce the beam to the acceleration orbit. The inflector includes a beam convergence unit that converges the beam passing through the inflector.

DETAILED DESCRIPTION

Figure 1:
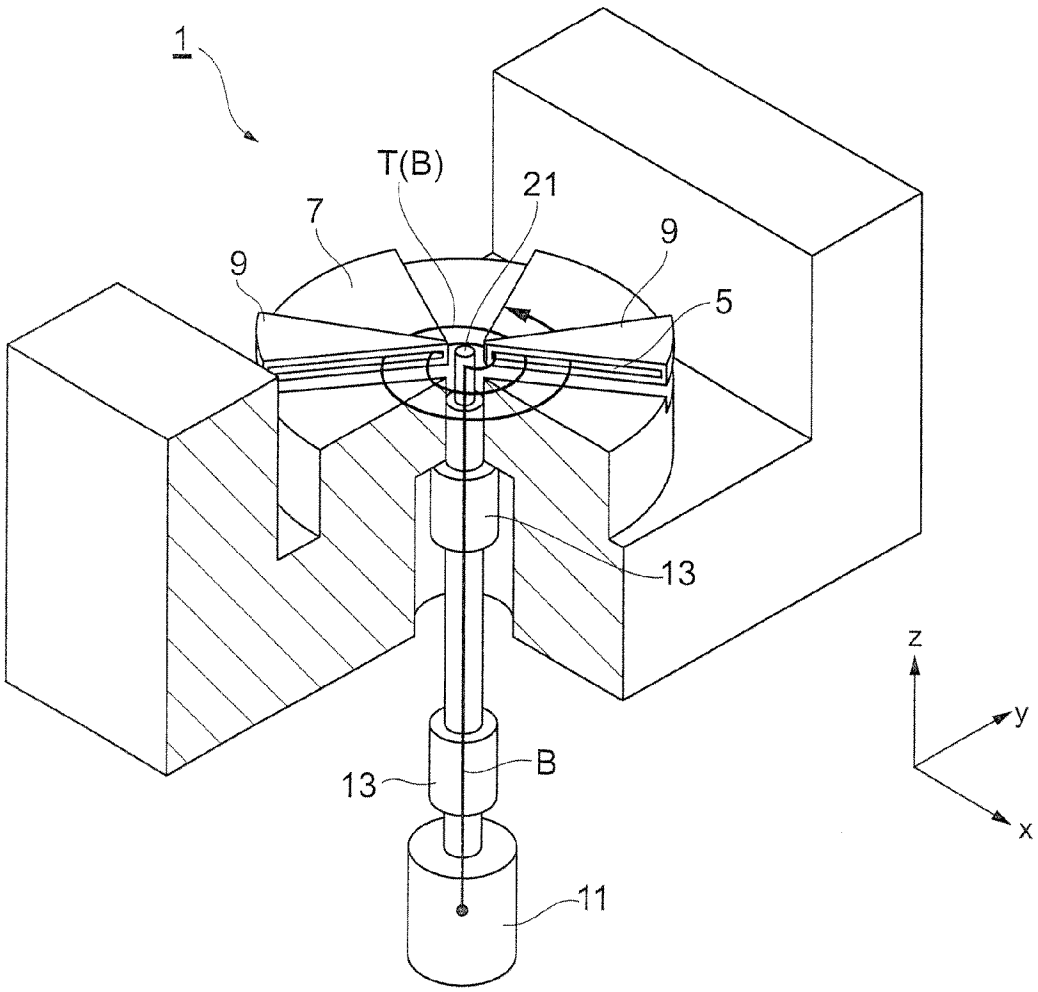
FIG. 1 is a perspective view of an accelerator (cyclotron) according to an embodiment of the invention.

In this kind of accelerator, the beam to be introduced to the acceleration orbit is diffused, so that a part of the beam collides with inner walls partitioning the acceleration space and disappears. A ratio of a beam, which is finally output from the accelerator, is decreased by the loss of the beam. Accordingly, in order to increase the ratio of the beam, which is finally obtained, in this kind of accelerator, there is a demand for the suppression of the diffusion of the beam to be introduced to the acceleration orbit in order to reduce a beam colliding with the inner walls of the acceleration space.

Accordingly, it is desirable to provide a cyclotron and an accelerator that can suppress the diffusion of a beam to be introduced to an acceleration orbit.

In the accelerator, the inflector includes the beam convergence unit. Accordingly, the beam entering from the ion source is converged by the beam convergence unit of the inflector and introduced to the acceleration orbit, so that it may be possible to suppress the diffusion of the beam to be introduced to the acceleration orbit.

Specifically, the beam convergence unit may generate a distorted quadrupole-component electric field in a beam passing area through which the beam passes. In this case, the beam passing through the inflector is converged by the distorted quadrupole-component electric field generated by the beam convergence unit. Accordingly, the diffusion of the beam to be introduced to the acceleration orbit is suppressed.

Further, the inflector may include positive and negative electrodes facing each other with a gap, which forms the beam passing area, therebetween. The positive and negative electrodes may be formed so that the width of the gap is not constant in a cross-section perpendicular to a traveling direction of the beam.

In this case, an electric field, which is caused by the positive and negative electrodes, is generated in the beam passing area the inflector. Further, since the gap between the positive and negative electrodes is not constant in the cross-section perpendicular to the traveling direction of the beam, the beam is affected by an electric field corresponding to the passing position of the cross-section and is bent according to the passing position. Accordingly, it may be possible to converge the beam that passes through the beam passing area.

Specifically, the acceleration orbit may have a convoluted shape, and the width of the gap may be increased toward a position corresponding to the outer side of the acceleration orbit, which has the convoluted shape, in the cross-section perpendicular to the traveling direction of the beam.

Moreover, the acceleration orbit may have a convoluted shape; the beam convergence unit may generate an electric field in a beam passing area through which the beam passes; and the intensity of the electric field may become weak toward a position corresponding to the outer side of the acceleration orbit, which has the convoluted shape, in a cross-section perpendicular to a traveling direction of the beam.

In the cyclotron, the inflector includes the beam convergence unit. Accordingly, the beam entering from the ion source is converged by the beam convergence unit of the inflector and introduced to the acceleration orbit, so that it may be possible to suppress the diffusion of the beam to be introduced to the acceleration orbit.

According to the accelerator and the cyclotron of the embodiments of the invention, it may be possible to suppress the diffusion of the beam to be introduced to the acceleration orbit.

A cyclotron and an accelerator according to preferred embodiments of the invention will be described below in detail with reference to the drawings.

A cyclotron 1 shown in FIG. 1 is an accelerator that accelerates an ion particle beam B entering from an ion source 11 and outputs the beam. The cyclotron 1 has an acceleration space 5 which has a circular shape in plan view and through which the beam B passes and is accelerated. Here, the cyclotron 1 is installed so that the acceleration space 5 extends horizontally. When used in the following description, words including the concepts of "upper" and "lower" correspond to the upper and lower sides of the cyclotron 1 that is in a state shown in FIG. 1. Further, when necessary, an xyz coordinate system, which uses a z-axis as a vertical axis and uses an x-y plane as a horizontal plane, may be set as shown in FIG. 1 and x, y, and z may be used for descriptive purposes.

The cyclotron 1 includes magnetic poles 7 that are provided above and below the acceleration space 5. Meanwhile, the magnetic pole 7 provided above the acceleration space 5 is not shown. The magnetic poles 7 generate a vertical magnetic field in the acceleration space 5. Further, the cyclotron 1 includes a plurality of D-electrodes 9 that has fan shape in plan view. The D-electrode 9 has a cavity that passes through the D-electrode in a circumferential direction, and the cavity forms a part of the acceleration space 5. When alternating current is supplied to the plurality of D-electrodes 9, the D-electrodes 9 generate a potential difference in the circumferential direction in the acceleration space 5. Accordingly, a beam B is accelerated by the potential difference. A beam B, which is introduced substantially to the center of the acceleration space 5, is accelerated by the actions of the magnetic field generated by the magnetic poles 7 and the electric field generated by the D-electrodes 9 while forming an acceleration orbit T, which has a convoluted shape on the horizontal plane, in the acceleration space 5. The accelerated beam B is finally output in the tangential direction of the acceleration orbit T. Since the above-mentioned structure of the cyclotron 1 is well-known, more detailed description thereof will be omitted.

The ion beam B is generated by the ion source 11 provided below the cyclotron 1, and enters the cyclotron 1 in an incident direction, which is directed vertically upward, through two solenoids 13. Meanwhile, the solenoids 13 function to prevent the beam B from being diffused. The beam B, which enters in the vertical direction, needs to be bent to the horizontal direction in the cyclotron 1 so that the beam B is introduced to the acceleration orbit T. Accordingly, the cyclotron 1 includes a spiral inflector 21 that is provided at the center of the acceleration space 5. The inflector 21 bends the beam B entering from below, and emits the beam in the horizontal direction substantially at the center of the acceleration space 5. The emitted beam B is introduced to the above-mentioned acceleration orbit T and accelerated.

Figure 2:
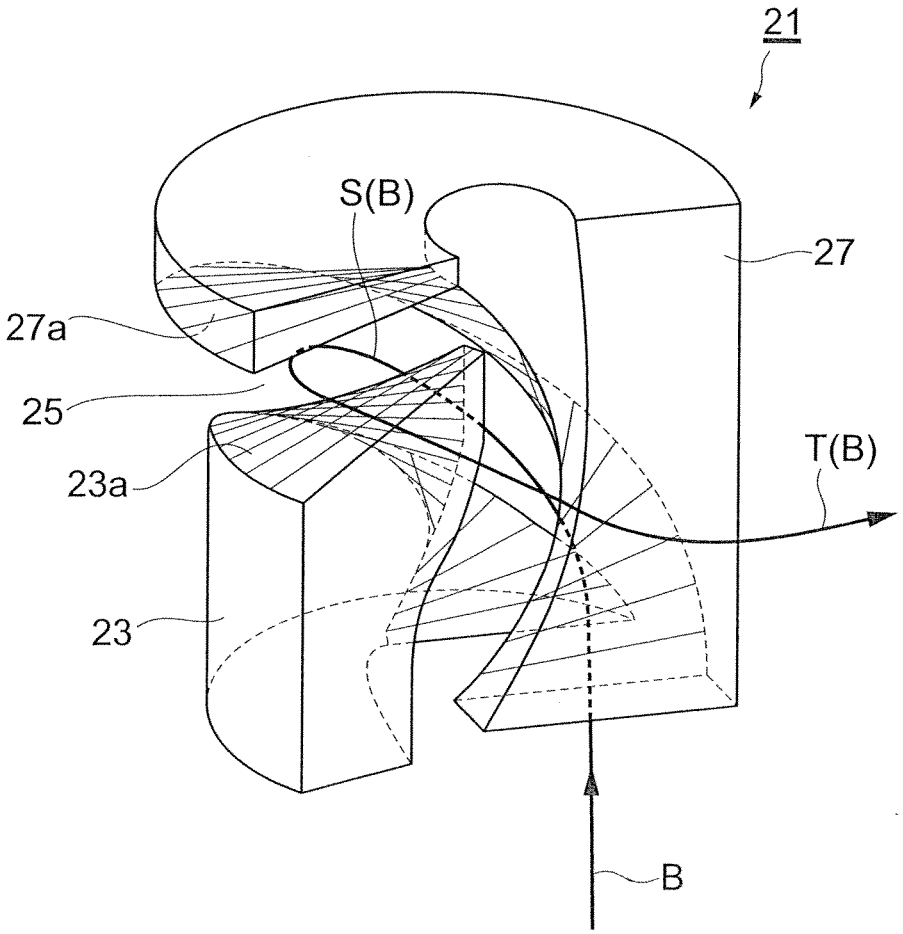
FIG. 2 is a perspective view of a spiral inflector of the cyclotron shown in FIG. 1.

As shown in FIG. 2, the inflector 21 includes positive and negative electrodes 23 and 27 that are formed of metal blocks (for example, copper blocks) and face each other. The positive and negative electrodes 23 and 27 are connected to different constant-voltage power sources (not shown), respectively. A positive electrode surface 23*a*, which forms a curved surface having the shape of a twisted strip, is formed on the surface of the positive electrode 23, and a negative electrode surface 27*a*, which forms a curved surface having the shape of a twisted strip, is formed on the surface of the negative electrode 27. The positive and negative electrode surfaces 23*a* and 27*a* are positioned so as to face each other with a predetermined gap therebetween. An electric field, which is generated by the potential difference between the positive and negative electrodes 23 and 27, is formed in the spiral space that is formed of the gap. Meanwhile, the polarities of the electrodes 23 and 27 may be reversed according to the polarity (positive and negative) of ions that form the ion beam B.

The beam B, which is directed vertically upward, enters from a gap between the positive and negative electrode surfaces 23*a* and 27*a* at the lower portion of the inflector 21. The beam B, which has entered the gap, is affected by the electric field, which is generated by the potential difference between the positive and negative electrodes 23 and 27, and the magnetic field that is generated by the magnetic poles 7. Accordingly, the beam travels while being spirally bent along the gap. Further, the beam B is horizontally emitted from the gap between the positive and negative electrode surfaces 23*a* and 27*a* at the upper portion of the inflector 21. After being emitted from the inflector 21, the beam B goes into the acceleration orbit T while being convoluted counterclockwise as seen from above. Meanwhile, an ideal passing orbit of a beam in the inflector 21 is denoted by reference character "S". As described above, the spiral space, which is formed of the gap, serves as a beam passing area 25 through which a beam passes.

Subsequently, the width of the gap between the positive and negative electrodes 23 and 27 will be described.

Figure 3:
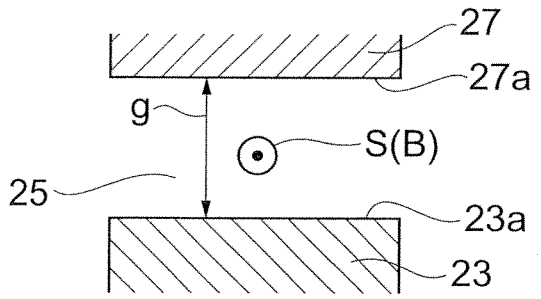
FIGS. 3A, 3B, and 3C are views schematically showing the cross-sectional shape of a positive electrode and a negative electrode.
Figure 3:
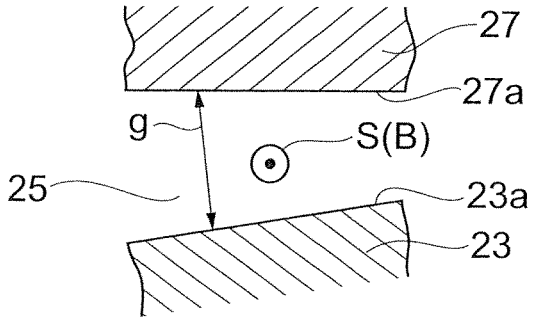
Figure 3:
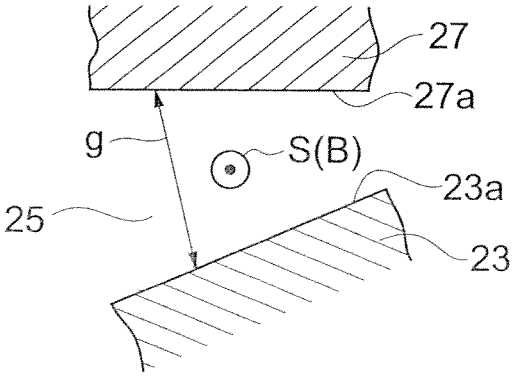

FIG. 3 includes schematic cross-sectional views showing the cross-section, which is perpendicular to the passing orbit S, of the vicinity of the beam passing area 25. FIG. 3A shows the cross-section of the beam passing area at the position of the lower end surface of the inflector 21, FIG. 3B shows the cross-section of the beam passing area at an arbitrary position in the inflector 21, and FIG. 3C shows the cross-section of the beam passing area at an arbitrary position on the passing orbit S on the front side (downstream side) of the position of FIG. 3B. FIGS. 3*a*, 3*b*, and 3*c* are cross-sectional views as seen in a direction where the beam B on the passing orbit S travels to the front side from the back side of the plane of each drawing.

As shown in FIG. 3A, on the lower end surface of the inflector 21, the positive and negative electrode surfaces 23*a* and 27*a* are parallel to each other and the width g of the gap is constant. When an arbitrary cross-section is taken as shown in FIGS. 3B and 3C, the width g of the gap between the positive and negative electrodes 23 and 27 is not constant in the cross-section and is increased toward the left side in FIGS. 3B and 3C. Meanwhile, the left side in FIG. 3 corresponds to the outer side of the convoluted acceleration orbit T and the right side in FIG. 3 corresponds to the inner side of the convoluted acceleration orbit T.

In other words, when an arbitrary cross-section perpendicular to the passing orbit S is taken, the positive and negative electrodes 23 and 27 are formed so that the profiles of the positive and negative electrode surfaces 23*a* and 27*a* form a V shape. Further, FIG. 3C shows the cross-section of the beam passing area at the position on the passing orbit S on the front side (downstream side) of the position of FIG. 3B. As understood from the comparison of FIGS. 3B and 3C, the positive and negative electrodes 23 and 27 are formed in a three-dimensional shape where the difference between the widths g of the right and left portions of the gap is increased toward the front side on the gassing orbit S.

According to the setting of the width g of the gap described above, the distribution of an electric field, which is generated by the electrodes 23 and 27 and becomes weak toward the positron corresponding to the outer side of the acceleration orbit T (the left side in FIG. 3) and becomes strong toward the position corresponding to the inner side of the acceleration orbit T, is formed in the beam passing area 25. That is, as the passing position of the beam B is deviated to the left side in FIG. 3, a so-called distorted quadrupole-component electric field is generated in the beam passing area 25 so that a force applied to the beam B in a downward direction (or an upward direction) in FIG. 3 by the electric field is reduced. The structure of the electrodes 23 and 27, which generate the distorted quadrupole-component electric field, has a function as a beam convergence unit that converges the beam B passing through the inflector 21, particularly, in the vertical direction.

Accordingly, when a beam B passes through the beam passing area 25 where the distorted quadrupole-component electric field exists, the beam B introduced to the acceleration orbit T is converged, particularly, in the vertical direction (z-axis direction), so that the diffusion of the beam B in the vertical direction is suppressed. Further, since the diffusion of the beam B in the vertical direction is suppressed, the beams colliding with the inner walls the D-electrode 9 decreased in the acceleration space 5. As a result, it may be possible to increase the ratio of the beam B that is finally output from the cyclotron 1 (which may be referred to as the transmittance of the cyclotron).

If the width g of the gap is expressed by a specific expression as a specific example that obtains the above-mentioned width g of the gap, the following expression (1) is obtained.

$$g = \frac{g_o}{\sqrt{1 + k'^2 \sin^2 b}}\left(1 - \eta \frac{w}{W/2} \sin b\right) \quad \text{[Expression 1]}$$

g: the width of a gap at a predetermined position $g_o$: the width of a gap at an inflector inlet k': tilt parameter b: b=s/A s: a distance between the inflector inlet and the predetermined position measured along a passing orbit S A: the height of the inflector η: the intensity of a distorted quadrupole-component electric field W: the width of the inflector w: the position of the predetermined position in the width (W) direction Meanwhile, the height A of the inflector means a length between an inflector inlet of the beam B and an inflector outlet of the beam B that is measured in the vertical direction. The inlet of the beam B is a theoretical position where the application of an electric field generated by the electrodes 23 and 27 to the beam B starts, and is positioned slightly below the lower end surface of the inflector 21. Further, the outlet of the beam B is a theoretical position where the application of an electric field generated by the electrodes 23 and 27 to the beam B is terminated, and is positioned slightly in front of the positions of the upper ends of the positive and negative electrode surfaces 23*a* and 27*a* in the traveling direction of the beam B. The tilt parameter k' is a parameter that represents the tilt of the beam passing area 25 in the plane perpendicular to the passing orbit S. Further, the width W of the inflector means the width of the beam passing area 25. At the inflector inlet, "b=0" is satisfied and the positive and negative electrode surfaces 23*a* and 27*a* are parallel to each other. Furthermore, "b=π/2" is satisfied at the inflector outlet. As understood from Expression (1), the width g of the gap depends on w.

Figure 4:
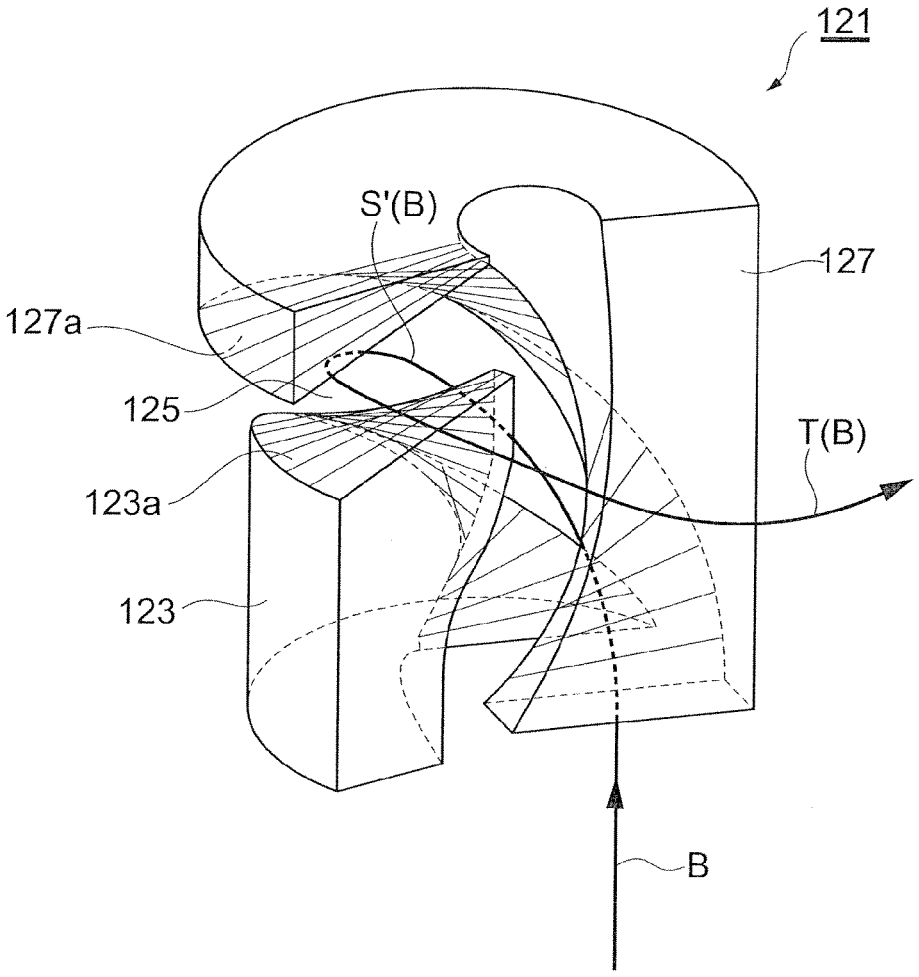
FIG. 4 is a perspective view showing an inflector similar to the spiral inflector shown in FIG. 2.

Meanwhile, for the purpose of comparison, another type of spiral inflector (hereinafter, referred to as a "similar inflector") 121 similar to the inflector 21 is shown in FIG. 4. In this similar inflector 121, a gap between positive and negative electrodes 123 and 127 is constant in all the cross-sections perpendicular to a passing orbit S' of a beam B. That is, the positive and negative electrodes 123 and 127 are formed so that the profiles of positive and negative electrode surfaces 123*a* and 127*a* appearing in all the cross-sections perpendicular to the passing orbit S' are parallel to each other. In the similar inflector 121, only bipolar components of an electric field of a beam passing area 125 are generated. For this reason, the advantage of converging a beam as in the inflector 21 is not obtained.

Subsequently, a simulation, which is performed by the inventors for confirmation of the advantage of the inflector 21, will be described.

Figure 5:
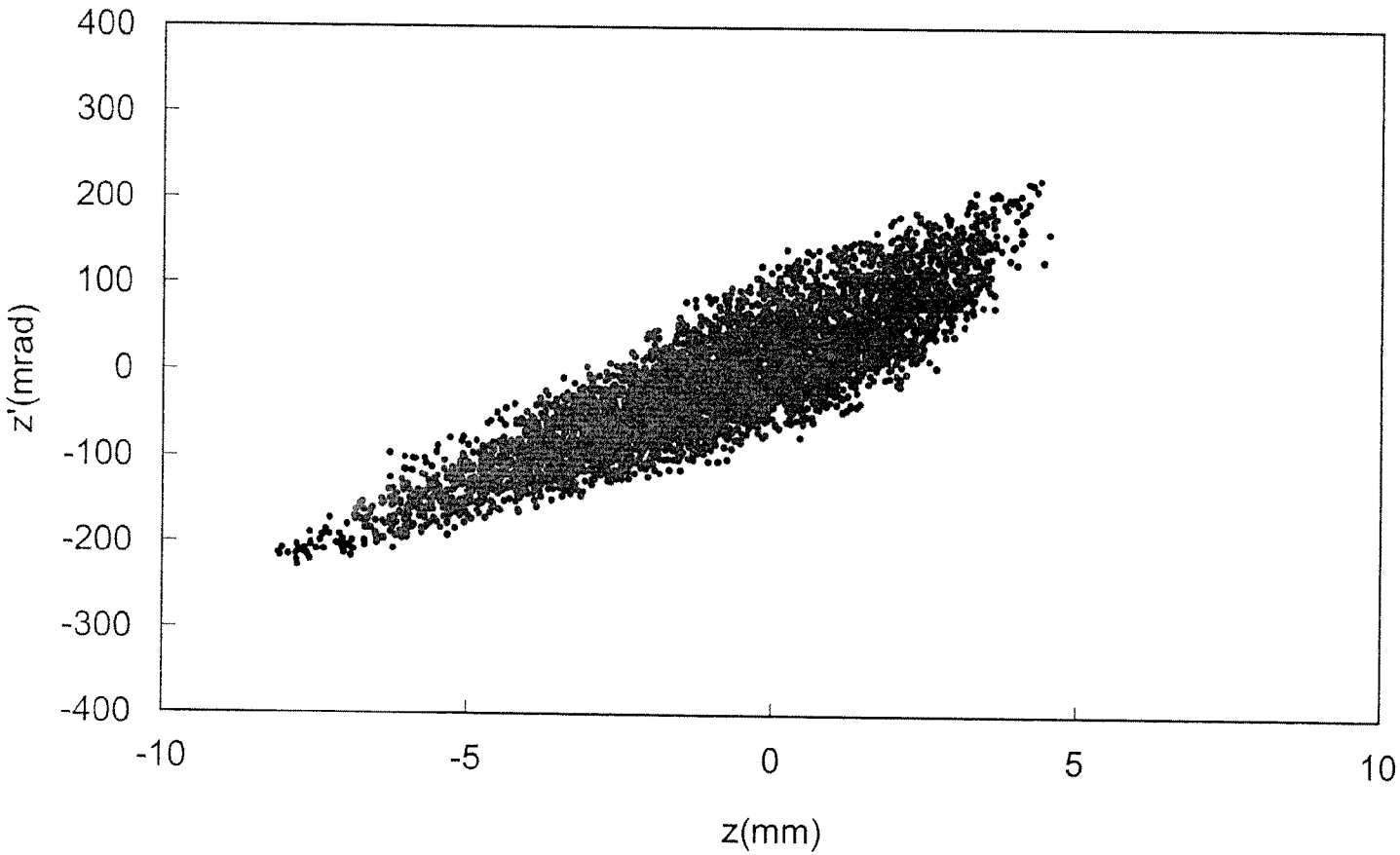
FIG. 5 is a graph showing the result of a simulation that is performed by the inventors.

Here, a simulation where 5000 ion particles of a beam pass through the inflector 21 is performed. z values and z' values of the ion particles at the outlet of the inflector 21 are plotted, and the distribution thereof is shown in FIG. 5. The z value represents the passing position (mm) of the ion particle in the vertical direction, and the z' value represents the traveling direction of the particle by an angle (mrad) from the horizontal plane. Further, for the purpose of comparison, the same simulation as described above is performed on the similar inflector 121 and the results are shown in FIG. 6.

Figure 6:
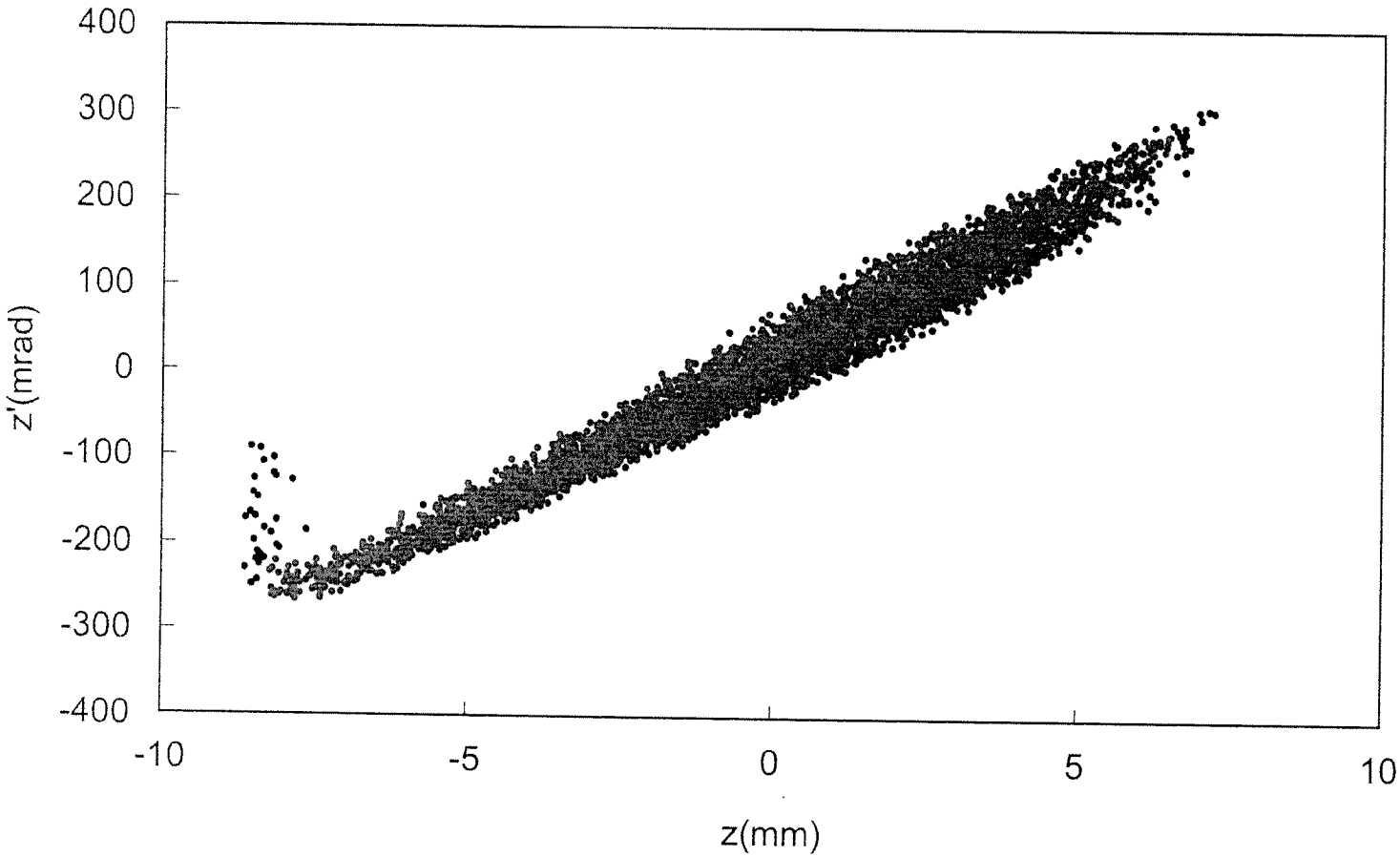
FIG. 6 is a graph showing the result of a simulation that is performed by the inventors.

From the comparison of FIGS. 5 and 6, it is found that the variations of the z values are small. This means that the upper and lower positions of the ion particles passing through the inflector 21 are uniform as compared to the similar inflector 121. Further, from comparison of FIGS. 5 and 6, it is found that the variations of the z' values are small and have angles close to zero mrad. This means that the ion particles passing through the inflector 21 have a strong tendency to be emitted at an angle close to the horizontally as compared to the similar inflector 121. Accordingly, according to the inflector 21, it is confirmed that an advantage of converging a beam B in the vertical direction is obtained as compared to the similar inflector 121.

The invention is not limited to the above-mentioned embodiment. For example, in the embodiment, the cyclotron 1 has been installed so that the acceleration space 5 extends horizontally. However, the invention may also be applied to an accelerator of which an acceleration space is disposed along a vertical plane. Further, the invention is not limited to a cyclotron and may also be applied to a synchrocyclotron (accelerator).

Figure 7:
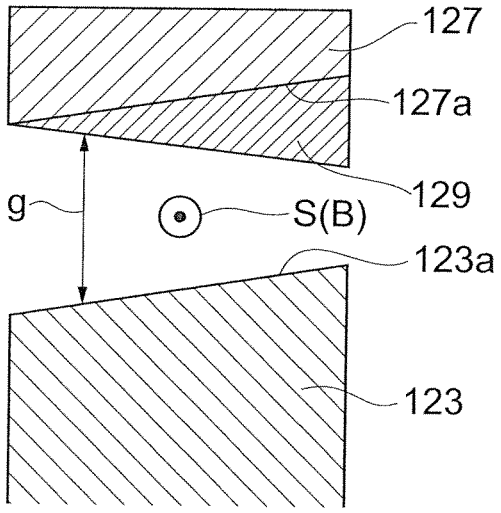
FIG. 7 is a schematic cross-sectional view showing the cross-section of another example of the inflector that that is perpendicular to a passing orbit.
Figure 8:
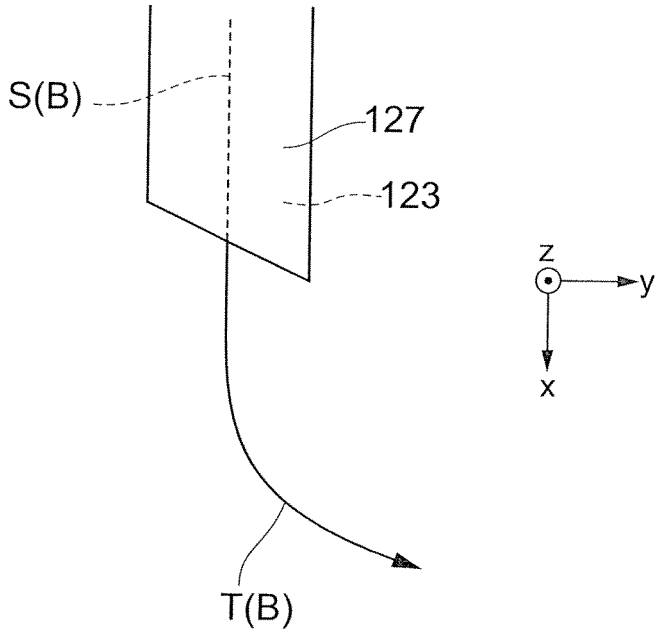
FIG. 8 is a plan view showing the vicinity of a beam outlet of still another example of the inflector as seen from above.

Furthermore, the above-mentioned gap may be formed by using a pair of plate-like electrodes, which is twisted and has a uniform thickness, instead of the electrodes 23 and 27 formed of metal blocks, and disposing the electrodes so that a V-shaped cross-section is formed. Moreover, in order to form the structure where the width g of the gap depends on w, for example, a metal member 129 having a triangular cross-section may be bonded to the negative electrode surface 127*a* of the similar inflector 121 as shown in FIG. 7. Further, in order to form a distorted quadrupole-component electric field in the beam passing area 25, distorted quadrupole magnets may be installed in front of the beam outlet of the similar inflector 121. Furthermore, in order to form a distorted quadrupole-component electric field in the beam passing area 25, the lengths of the electrodes 127 and 123 of the similar inflector 121 seen from above may be set to be long up to a position corresponding to the inner side of the acceleration orbit T in the traveling direction of a beam as shown in FIG. 8.

It should be understood that the invention is not limited to the above-described embodiment, but may be modified into various forms on the basis of the spirit of the invention. Additionally, the modifications are included in the scope of the invention.

What is claimed is:

1. An accelerator comprising:

an inflector through which a beam entering from an ion source passes and which introduces the beam to an acceleration orbit, wherein the inflector includes a beam convergence unit configured to converge the beam passing through the inflector, wherein the beam convergence unit generates a distorted quadrupole-component electric field in a beam passing area through which the beam passes, wherein the inflector includes positive and negative electrodes facing each other with a gap, which forms the beam passing area, therebetween, and the positive and negative electrodes are formed so that a width of the gap is not constant in a cross-section perpendicular to a traveling direction of the beam, wherein the acceleration orbit has a convoluted shape, and the width of the gap is increased toward a position corresponding to an outer side of the acceleration orbit, which has the convoluted shape, the cross-section perpendicular to the traveling direction of the beam.

2. An accelerator comprising:

an inflector through which a beam entering from an ion source passes and which introduces the beam to an acceleration orbit, wherein the inflector includes a beam convergence unit configured to converge the beam passing through the inflector, wherein the acceleration orbit has a convoluted shape, the beam convergence unit generates an electric field in a beam passing area through which the beam passes, and an intensity of the electric field becomes weak toward a position corresponding to an outer side of the acceleration orbit, which has the convoluted shape, in a cross-section perpendicular to a traveling direction of the beam.

3. The accelerator according to claim 2, wherein the beam convergence unit generates a distorted quadrupole-component electric field in a beam passing area through which the beam passes.

4. The accelerator according to claim 3, wherein the inflector includes positive and negative electrodes facing each other with a gap, which forms the beam passing area, therebetween, and the positive and negative electrodes are formed so that a width of the gap is not constant in a cross-section perpendicular to a traveling direction of the beam.

5. A cyclotron that accelerates a beam in a convoluted acceleration orbit, the cyclotron comprising:

magnetic poles configured to generate a magnetic field in a direction perpendicular to the acceleration orbit;

D-electrodes generating a potential difference, which accelerates the beam, in the acceleration orbit; and an inflector through which a beam entering in an incident direction perpendicular to the acceleration orbit passes and which bends the beam so as to introduce the beam to the acceleration orbit, wherein the inflector includes a beam convergence unit configured to converge the beam passing through the inflector, wherein the acceleration orbit has a convoluted shape, the beam convergence unit generates an electric field in a beam passing area through which the beam passes, and an intensity of the electric field becomes weak toward a position corresponding to an outer side of the acceleration orbit, which has the convoluted shape, in a cross-section perpendicular to a traveling direction of the beam.

* * * * *